US005246349A

United States Patent [19]

Hartog

[11] Patent Number: 5,246,349

[45] Date of Patent: Sep. 21, 1993

[54] VARIABLE RELUCTANCE ELECTRIC MOTOR DRIVEN VACUUM PUMP

[75] Inventor: Richard G. Hartog, Michigan City, Ind.

[73] Assignee: Sullair Corporation, Michigan City, Ind.

[21] Appl. No.: 995,649

[22] Filed: Dec. 18, 1992

Related U.S. Application Data

[63] Continuation of Ser. No. 670,680, Mar. 18, 1991, abandoned.

[51] Int. Cl.[5] ..... F04F 35/04

[52] U.S. Cl. ..... 417/371; 417/410 C

[58] Field of Search ..... 417/410 R, 410 C, 371

[56] References Cited

U.S. PATENT DOCUMENTS 3,932,069 1/1976 Glandini et al. ..... 417/420
4,780,061 10/1988 Butterworth ..... 417/371

FOREIGN PATENT DOCUMENTS 40316 3/1979 Japan ..... 417/371
215986 12/1984 Japan ..... 417/371
237389 9/1985 Japan ..... 417/371
9979 1/1990 Japan ..... 417/371

*Primary Examiner*—Richard E. Gluck
*Attorney, Agent, or Firm*—Ted E. Killingsworth; William H. Lanyi

[57] ABSTRACT

A motor driven compressor is provided with a means through which the internal portion of the motor is maintained at a pressure below atmospheric pressure when the compressor is operating. This reduced pressure within the motor reduces the windage losses of the motor and reduces the noise generated which as a result emanates from the motor. The present invention is most suitable for use in association with a variable reluctance motor connected in torque provided relation with a screw compressor, wherein the screw compressor is utilized as a vacuum pump. The internal portion of the motor is connected in fluid communication with the suction port of the vacuum pump and this association reduces the pressure within the motor and reduces both the windage losses and the noise emanating from the motor.

4 Claims, 3 Drawing Sheets

VARIABLE RELUCTANCE ELECTRIC MOTOR DRIVEN VACUUM PUMP

This is a continuation of application Ser. No. 670,680, filed Mar. 18, 1991, now abandoned.

BACKGROUND OF THE INVENTION

1. Field of the Invention

The present invention relates generally to motor driven compressors and, more particularly, to a compressor that is utilized as a vacuum pump and driven by a variable speed motor. Even more particularly, the present invention is directed to a screw compressor used as a vacuum pump and driven by a variable reluctance motor, wherein the variable reluctance motor is connected in fluid communication with the inlet port of the compressor so that the internal portion of the variable reluctance motor can be maintained at a pressure below atmospheric pressure.

2. Description of the Prior Art

It is well known to drive a compressor with a motor and equally well known to drive a screw compressor with an electric motor. It is also well known to those skilled in the art to utilize a screw compressor for the purpose of maintaining a vacuum in a system. When utilized in this manner, the compressor is generally referred to as a vacuum pump.

U.S. Pat. No. 3,790,309, which issued to Volz on Feb. 5, 1974, describes a unitary pump and motor assembly with a common drive shaft. Although the pump is not a screw pump in the strictest sense of this terminology, it is driven by the motor and a secondary flow of liquid from the compressor is forced to flow through the motor as a result of the presence of helical passages in the rotor.

U.S. Pat. No. 3,740,630, which issued to Jarret et al on Jun. 19, 1973, describes a variable reluctance electric motor. Although the variable reluctance electric motor described in this patent is not attached to a pump, the cross sectional views shown in the patent illustrate the different geometric configurations disposed in the air gap of the motor as compared to the air gap of a conventional electric motor such as that described in U.S. Pat. No. 3,790,309 discussed above.

German Patent 207,956 describes a cooling system for a screw compressor assembly. To reduce the temperature of the motor which drives the screw compressor, a small portion of the output from the compressor is directed to an inlet of the motor and caused to flow through the motor prior to returning to an additional inlet of the screw compressor. From a description of the invention, it appears that the fluid flowing into the motor is a liquid. Since the fluid is flowing to the motor bypasses the expansion valve 5 and evaporator 4 of the system described in this patent, it further appears that the liquid entering the motor 2 is expected to be caused to evaporate by the heat of the motor and the relevant pressure changes prior to entering the inlet port of the compressor as a gas.

As a result of recent development in the field of variable reluctance motors and their electronic control systems, it has become advantageous to use variable reluctance motors to drive screw compressors. One of the significant advantages of using a variable reluctance motor to drive a screw compressor is the fact that the variable reluctance motor permits the motor and compressor to be operated at a virtually infinite variety of speeds within the capacity of the motor. This, in turn, permits the compressor to be controlled in a manner which responds advantageously to changes and demands and pressures within the system.

Notwithstanding these significant advantages, the use of variable reluctance motors also create certain disadvantages which must be addressed. First, the shape of the rotor in a variable reluctance motor is such that it does not usually have a smooth outer cylindrical surface. Instead, it has very prominent poles that extend radially from the central axis of the rotor. These poles create severe irregularities in the rotor shape and these irregularities exacerbate the air resistance and noise problems that occur when one member of a dynamoelectric machine rotates in close proximity to another member. In other words, when the irregularly shaped motor rotates within the stator of a variable reluctance motor, the air resistance encountered by the rotor is more severe than that encountered by a rotor of a conventional electric motor with a smooth outer cylindrical surface. Not only does the rotor encounter more severe air resistance but, in addition, the movement of the rotor through the air creates a significant source of noise within the region of the air gap of the variable reluctance motor. These problems are further exacerbated by the fact that variable reluctance motors are typically operated at speeds much higher than those of conventional electric motors.

To improve the motor driven compressor system which utilizes a variable reluctance motor, some means must be provided to reduce the air resistance and noise which are incumbent with the use of a variable reluctance rotor because of its irregular rotor shape and high speed of operation. The present invention is directed to the solution of those problems.

SUMMARY OF THE INVENTION

The present invention is directed to a system through which the air resistance and windage losses inside a variable reluctance motor can be significantly reduced. More particularly, the present invention is directed to a motor driven compressor assembly in which the internal portions of a variable reluctance motor are disposed in fluid communication with an inlet port of a compressor to lower the density of the gas within the motor.

The motor driven compressor of the present invention comprises a screw compressor which has a suction port and a discharge port. A motor is connected in torque providing relation with a rotatable component, or rotor, of the screw compressor with the motor having a gas inlet and a gas outlet. The gas outlet of the motor is connected in fluid communication with the suction port of the screw compressor. The gas outlet and the suction port are associated together to force all of the gas passing through the compressor to first pass through the motor. In a preferred embodiment of the present invention, the motor is a variable reluctance motor and a screw compressor is utilized as a vacuum pump. As such, the motor and the screw compressor are associated together to maintain a pressure within the motor that is below atmospheric pressure when the screw compressor is operating. While a preferred embodiment of the present invention forces all of the gas passing through the compressor to first pass through the motor, it should be understood that the advantages realized from the present invention can be achieved without forcing all of the gas to first pass through the motor. Instead, as will be described in greater detail below, the motor can be connected in fluid communication with the suction port of the compressor so that the internal portion of the motor can be maintained below atmospheric pressure even though a significant portion of the gas flow does not pass through the motor.

By maintaining the internal portion of the variable reluctance motor below atmospheric pressure, the density of gas in the air gap region of the motor is significantly reduced. Since the noise generated by the rotating variable reluctance rotor varies directly with the gas density in the air gap and, in addition, since the wind resistance encountered by the variable reluctance motor varies directly with the gas density within the air gap, a reduction of the density of the gas will reduce both the noise and windage losses inside the variable reluctance motor. Therefore, by providing a connection between the variable reluctance motor and the suction port of the compressor, the present invention permits the internal portions of the variable reluctance motor to be maintained at a pressure below atmospheric pressure and, as a result, the wind resistance encountered by the variable reluctance motor's rotor is reduced and the noise emanating from the variable reluctance motor is also reduced.

BRIEF DESCRIPTION OF THE DRAWING

The present invention will be more fully understood from a reading of a description of the preferred embodiment in conjunction with the drawing, in which.

DESCRIPTION OF THE PREFERRED EMBODIMENT

Figure 1:
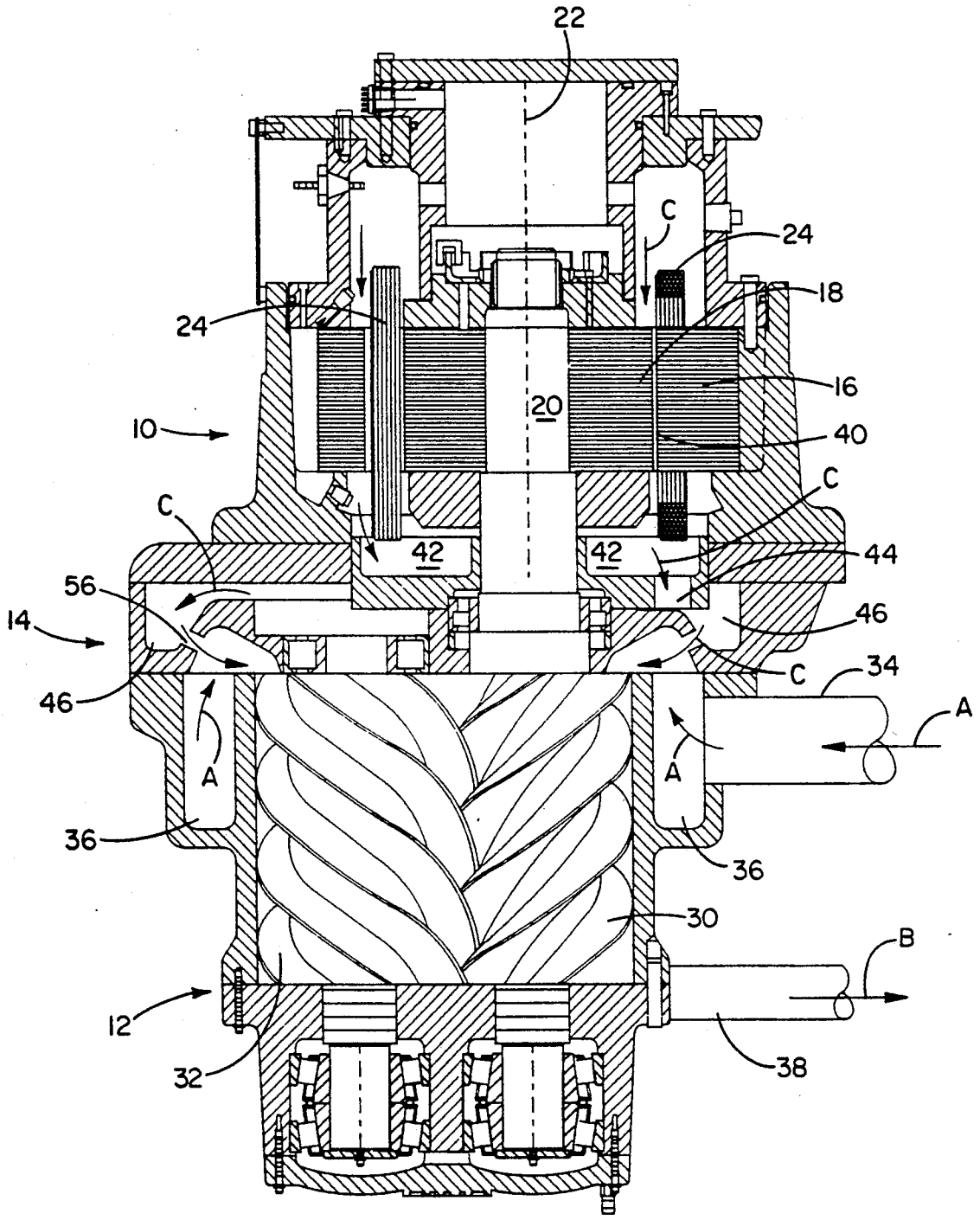
FIG. 1 illustrates a motor driven compressor made in accordance with one embodiment of the present invention.

Throughout the description of the preferred embodiment, like components will be identified with like reference numerals.

As discussed above, significant advantages can be achieved by driving a screw compressor with a variable reluctance motor. For example, the variable speed characteristic of a variable reluctance motor can be used to drive the screw compressor at virtually any one of an infinite number of speeds within the range of the motor. This allows the control system of the motor driven compressor to react to various demands to change the capacity of the compressor. In addition, the variable reluctance motor is typically able to achieve much higher speeds than conventional electric motors. For example, while typical electric motors operate at approximately 3600 RPM, variable reluctance motors can operate in excess of 10,000 RPM. However, because of the irregular shape of the rotor in a variable reluctance motor, windage losses are typically higher than conventional electric motors. These windage losses are further increased as a result of the high speeds at which variable reluctance motors normally operate. The combination of irregular rotor shape and high speed of operation creates significant windage losses and noise. The present invention is directed to solving these problems by reducing both the windage losses and the noise emanating from the motor. These goals are accomplished by reducing the density of the air within the motor and thus decreasing both windage losses an noise.

In FIG. 1, a variable reluctance motor 10 is shown attached to a screw compressor 12 with an adapter plate 14 disposed therebetween. The variable reluctance motor 10 is provided with a stator member 16 that is supported within the housing of the motor 10. A rotor is supported for rotation within the stator 16. The rotor has a plurality of laminations 18 attached to an axis shaft 20 which is arranged to rotate about a center of rotation 22. The stator 16 of the variable reluctance motor 10 is provided with a plurality of stator coils 24 which are each wound around a preselected stator pole. It should be understood that, in FIG. 1, one of the stator coils is shown in section view and the other stator coil is shown in a non-section view because of the particular section view taken of the motor.

The screw compressor 12 has two rotors supported for rotation in mesh relation with each other. A male rotor 30 is directly coupled in torque providing relation with the shaft 20 of the variable reluctance motor 10. A female rotor 32 is disposed in mesh relation with the male rotor 30. According to the well known operation of a screw compressor, the associated rotation of the male and female rotors compresses a gas as it flows through the screw compressor in a direction from a suction port to a discharge port. The suction port 34 is shown schematically in FIG. 1 to illustrate the fact that the inlet of the compressor is connected to a source from which the compressor draws gas and creates a vacuum. This will be discussed in greater detail below in conjunction with FIGS. 4 and 5. The gas flowing into the suction port 34, as indicated by arrows A, flows into a space proximate the inlet of the compressor 12 that is identified by reference numeral 36. From space 36, the gas is directed toward the suction end of the rotors 30 and 32. From there, the gas passes through the compressor and is compressed prior to its discharge through the discharge port 38 as indicated by arrows B.

In FIG. 1, it can be seen that the internal portion of the variable reluctance motor 10 is connected in fluid communication with the suction port 34. This is evidenced by arrows C which illustrate the fact that gas can pass from the internal portion of the motor toward and into the screw compressor inlet. While some of the arrows passing downward through the motor 10 and adapter plate 14 are identified by reference "C", it should be understood that all of the arrows above and within the adapter plate 14 represent the passage of gas from the internal portion of the motor into the compressor 12. The passage of this gas evacuates the internal portion of the motor 10 and reduces the density of gas within the motor. Since the internal portion of the motor 10 is exposed to the vacuum of the suction port 34, its density is decreased and its pressure is reduced to a magnitude less than atmospheric pressure. This reduction in density reduces the windage losses of the rotor and, in addition, reduces the noise emanating form the motor. While FIG. 1 is shown in significant detail, it should be understood that the particular configurations of the variable reluctance motor and the screw compressor in association with the adapter plate are only shown for purposes of illustration and should not be considered as limiting to the present invention. The important concept described in association with FIG. 1 is that the internal portion of the motor 10 is exposed to the suction port of the compressor and the pressure within the motor is reduced below atmospheric pressure. As illustrated in FIG. 1, the gas within the motor 10 can pass downward through the air gap 40 between the stator laminations and the rotor laminations. The gas can flow downward past the stator windings 24, through the opening identified by reference numeral 42, through the passage identified by reference numeral 44, through the space identified by reference numeral 46 and into the region proximate the inlet ends of rotors 30 and 32. This passage permits the gas within the motor 10 to be maintained at a suction pressure below atmospheric pressure and enables the present invention to reduce the problems of noise and windage problems described above.

Figure 2:
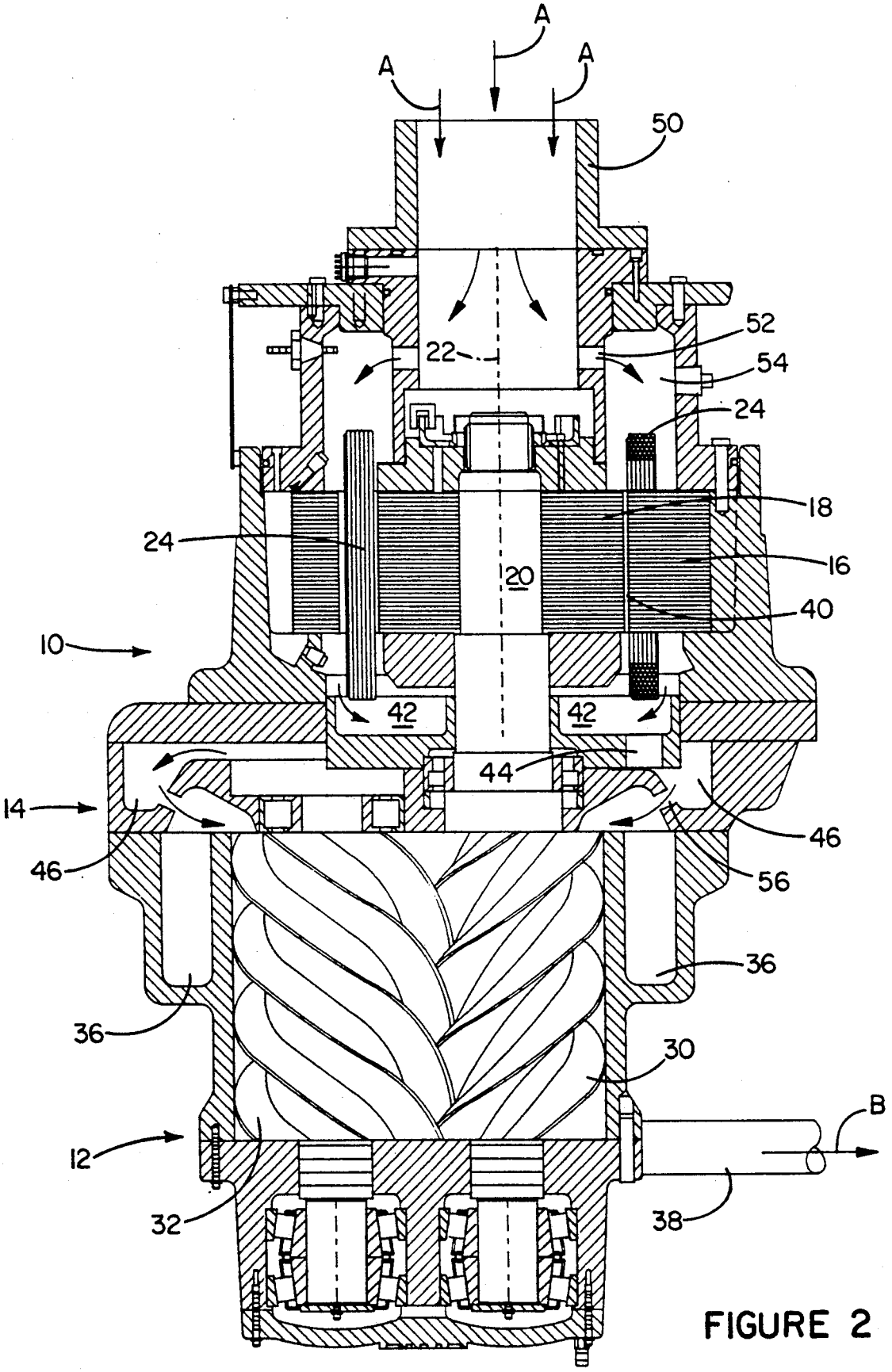
FIG. 2 shows a motor driven compressor made in accordance with a second embodiment of the present invention.

FIG. 2 illustrates another embodiment of the present invention which, although operating under the general concepts of the present invention, accomplishes the stated goals in a slightly different manner. In FIG. 2, a suction port 50 is provided at the upper end of the motor 10 rather than where the suction port 34 is shown connected in FIG. 1. In FIG. 1, the suction port 34 directs a flow of fluid directly into the space 36 of the compressor 12. In FIG. 2, the other embodiment of the present invention incorporates a suction port 50 attached to the motor where shown. Furthermore, the embodiment in FIG. 2 does not attach any suction port to the compressor at space 36.

In the embodiment shown in FIG. 2, all of the air passing through the compressor 12 must first pass through the motor 10. This passage of air through the motor 10 is illustrated by arrows A at the top portion of the Figure. As the air passes downward through the suction port 50, it passes through openings 52 into a region 54 directly above the stator 16 and stator coils 24. From there, the gas passes downward through the air gap 40 past the stator 16 and rotor laminations 18. The gas continues to flow downward into region 42 and through opening 44 into space 46. From space 46, the gas passes through opening 56 into the region at the suction end of the rotors 30 and 32. The gas is then drawn into the compressor suction end and compressed as it passes through the compressor and is eventually discharged through the discharge port 38.

Comparing the embodiments of FIGS. 1 and 2, it can be seen that the location of the suction port 34 in FIG. 1 does not force all of the gas to pass through the motor 10. Instead, it maintains a vacuum within the motor 10 because of the fluid communication between the motor and the suction port 34. While also maintaining a vacuum within the motor 10, the embodiment shown in FIG. 2 forces all of the gas to first pass through the motor 10 prior to passing through the compressor 12. This also maintains the pressure within the motor 10 at a vacuum pressure below atmospheric pressure, but also passes all of the gas through the motor 10. Either of these two embodiments will provide the result of a motor which is maintained below atmospheric pressure and reduce the windage losses that are normally experienced by a variable reluctance motor because of its irregularly shaped motor and its high speed of operation. These embodiments both reduce the noise which would otherwise emanate from the variable reluctance motor 10 because of the irregularly shaped rotor and high speed of operation.

Figure 3:
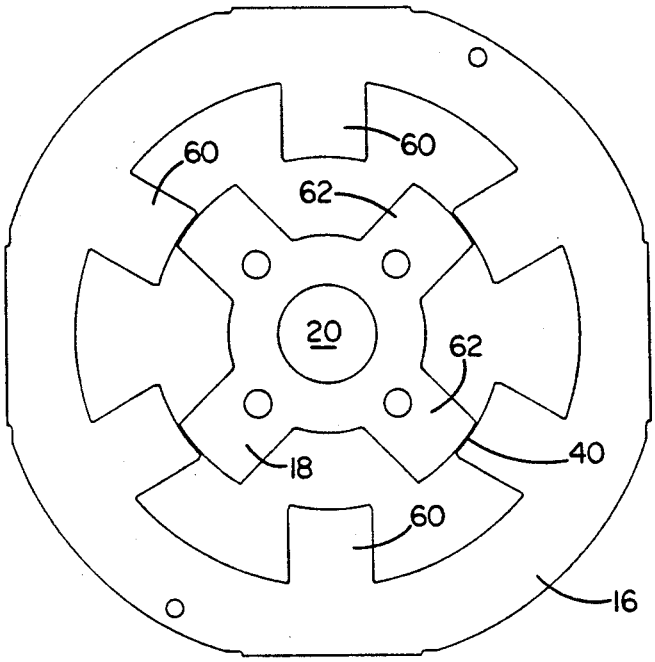
FIG. 3 illustrates the geometry of a variable reluctance motor, including its stator poles and rotor poles.

To more clearly understand the problems which the present invention is intended to solve, the rotor laminations 18 are shown in FIG. 3 in association with the stator laminations 16. As shown in FIG. 3, the rotor laminations 18 are mounted on a shaft 20 for rotation about a central axis of rotation such as that identified by reference numeral 22 in FIGS. 1 and 2. The stator laminations 16 are supported within the housing of the variable reluctance motor and each of the stator poles 60 is wound with a stator winding such as that identified by reference numeral 24 in FIGS. 1 and 2. Those windings are not shown in FIG. 3. The rotor lamination 18 comprises a plurality of rotor poles such as those identified by reference numeral 62 in FIG. 3. The maximum radial dimension of the stator laminations 18 are such that, in association with the minimum radial dimension of the stator lamination 16, a very small air gap 40 is provided therebetween.

As the rotor rotates about its central axis of rotation, the irregular shape of the rotor laminations 18 create a severe chopping of the air within the region of the rotor and the stator. This chopping of the air creates severe windage losses within the motor and creates a resistance to rotation of the rotor. In addition, beside creating windage losses which reduce the efficiency of the system, the irregular shape of the rotor and its high speed of rotation create noise which emanates from the motor. It is toward these problems that the present invention is directed. FIG. 3 is intended to illustrate the geometry which provides a partial source of these problems.

Figure 4:
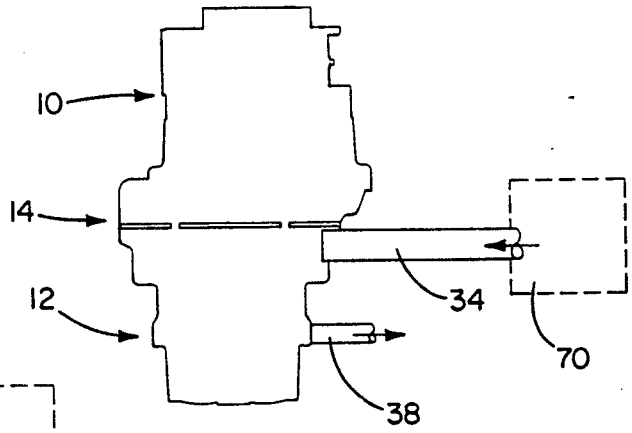
FIG. 4 illustrates a schematic diagram of a motor driven compressor made in accordance with one embodiment of the present invention.
Figure 5:
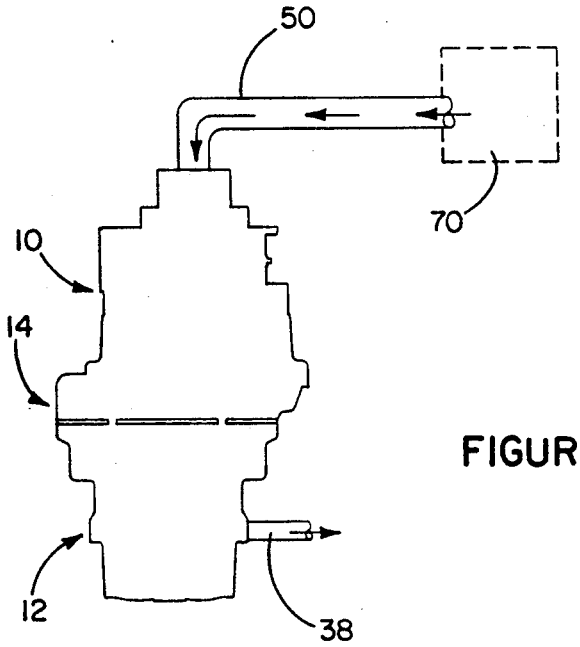
FIG. 5 shows a motor driven compressor made in accordance with a second embodiment of the present invention.

FIG. 4 and 5 illustrate the two embodiments of the present invention in a schematic manner for the purpose of describing the environment in which the present invention is most suited for operation. In FIG. 4, the motor 10 is shown in silhouette above the compressor 12. Also shown in FIG. 4 are the suction port 34 and the discharge port 38 of the compressor 12. In addition to the motor and compressor, FIG. 4 also shows a dashed box 70 which represents a vacuum environment that is maintained by the screw compressor 12 when operated as a vacuum pump. It should be understood that when operated as a vacuum pump, the screw compressor is typically incorporated within a closed system, such as a refrigeration system. According to techniques known to those skilled in the art, the suction port 34 is connected to one end of a refrigeration or vacuum system and the discharge port 38 is connected to another portion of the system. Within the refrigeration system, many processes take place which changes the pressure of the gas flowing through the system along with its temperature and other characteristics. The suction port 34 is used to draw gas from the system, which is represented by box 70, and the discharge port 38 is intended to provide gas to that system. Discharge port 38 in FIG. 4 is intentionally not shown connected to box 70 because of the fact that many other components are typically disposed between those elements and, in addition, box 70 is particularly intended to represent a vacuum region with which the suction port 34 is connected in fluid communication. As described in significant detail above, the connection of the suction port 34 to the compressor 12 in such a way that it is in fluid communication with the internal portion of the motor 10 provides the motor 10 with a means for maintaining internal pressure below atmospheric pressure and for achieving the goals described above.

FIG. 5 shows the other embodiment of the present invention in which the suction port 50 is connected at the upper portion of the motor 10 so that all of the gas passing through the compressor 12 must first pass through the motor 10. Dashed box 70 is used in FIG. 5 to illustrate a vacuum region connected in fluid communication with the suction port 50. The type of refrigeration or vacuum system represented by the presence of box 70 in FIG. 5 is similar in every respect to the range of systems represented by dashed box 70 in FIG. 4. The only significant difference between the embodiments shown in FIG. 4 and FIG. 5 is that all of the gas passing through suction port 50 in FIG. 5 must first pass through the motor 10 before passing through the compressor 12. In other words, all of the gas in the system which passes through the compressor 12 must first pass through the motor 10. This is not true with the embodiment illustrated in FIG. 4. Instead, the fluid communication between the internal portion of the motor 10 and the suction port 34 provides the decreased pressure within the motor 10 without requiring that all of the gas passing through the compressor 12 must first pass through the motor 10.

Although the present invention has been described with significant specificity and in a manner which describes the operation and structure of the present invention in significant detail, it should be understood that many other embodiments of the present invention are within its scope.

What I claim is:

1. A vacuum generator comprising:

a rotary vacuum pump including a pump housing having a gas inlet chamber communicating with the pump intake and a gas outlet communicating with the pump discharge;

an electric high speed variable reluctance motor operable at speeds in excess of 10,000 RPM, including a motor housing mounted adjacent the pump housing, a stator fixed in the motor housing and having angularly spaced, radially directed poles forming an irregular surface and arranged around a circular path, a rotor mounted in the motor housing and having angularly spaced radially directed poles forming an irregular surface and movable in a circular path past the stator poles, in an arrangement wherein the movement of the irregular surface of the rotor past the irregular surface of the stator generates noise and resistance to rotation;

means connecting the motor rotor to drive the vacuum pump;

and means communicating the vacuum pump inlet chamber with the interior of the motor housing to create a vacuum in the motor housing reducing the density of the gas in the motor housing when the pump is operating, thereby to reduce noise and resistance to rotation.

2. A vacuum generator as defined in claim 1, including means for communicating the pump inlet chamber with a system containing gas at less than the atmospheric pressure.

3. A vacuum generator comprising:

a rotary vacuum pump including a pump housing having a gas inlet chamber communicating with the pump intake, a gas outlet communicating with the pump discharge, and rotary intermeshing screw elements adapted to create a vacuum in the pump inlet chamber on rotation of the screw elements;

an electric high speed variable reluctance motor operable at speeds in excess of 10,000 RPM, including a motor housing mounted adjacent the pump housing, a stator fixed in the motor housing and having angularly spaced, inwardly directed poles forming an irregular surface and arranged around a circular path, a concentric rotor mounted in the motor housing and having angularly spaced outwardly directed poles forming an irregular surface and movable in a circular path past the stator poles, in an arrangement wherein the movement of the spaced rotor poles past the spaced stator poles generates noise and resistance to rotation;

means connecting the motor rotor to drive the screw elements in the vacuum pump;

and means communicating the vacuum pump inlet chamber with the interior of the motor housing to create a vacuum in the motor housing reducing the density of the gas in the motor housing when the pump is operating, thereby to reduce noise and resistance to rotation.

4. A vacuum generator as defined in claim 3, including means for communicating the motor housing with a system containing gas at less than atmospheric pressure.

* * * * *